US006176759B1

(12) United States Patent
Trageser

(10) Patent No.: US 6,176,759 B1
(45) Date of Patent: Jan. 23, 2001

(54) PUSH-PULL TOY HAVING PIVOTING ARMS

(75) Inventor: Mark Trageser, Los Angeles, CA (US)

(73) Assignee: Mattel, Inc., El Segundo ( * ) Notice: Under 35 U.S.C. 154(b), the term of this patent shall be extended for 0 days.

(21) Appl. No.: 09/244,614

(22) Filed: Feb. 4, 1999

(51) Int. Cl.[7] ..... A63H 5/00; A63H 11/12
(52) U.S. Cl. ..... 446/272; 446/278
(58) Field of Search ..... 446/376, 270, 446/272, 274, 275, 278, 279, 286, 287, 448, 450, 466, 425

(56) References Cited

U.S. PATENT DOCUMENTS

| | | | | |
|---|---|---|---|---|
| D. 360,237 | | 7/1995 | Chiu . | |
| 2,424,607 | * | 7/1947 | Fisher | 446/278 |
| 3,782,751 | | 1/1974 | Williams . | |
| 3,827,179 | | 8/1974 | Reiling, Jr. . | |
| 4,216,612 | * | 8/1980 | Erickson et al. | 446/272 X |
| 4,568,307 | | 2/1986 | Gabler et al. . | |
| 4,573,944 | | 3/1986 | Crow et al. . | |
| 4,576,586 | * | 3/1986 | Amici et al. | 446/315 |
| 4,654,659 | * | 3/1987 | Kubo | 446/272 X |
| 4,693,697 | | 9/1987 | Pagano . | |
| 4,772,242 | * | 9/1988 | McKay et al. | 446/448 |
| 4,930,831 | | 6/1990 | Valiga et al. . | |
| 4,993,983 | * | 2/1991 | Kurita et al. | 446/272 |
| 5,135,243 | | 8/1992 | Carpenter . | |
| 5,334,078 | | 8/1994 | Hippely et al. . | |
| 5,360,222 | | 11/1994 | Bro et al. . | |
| 5,474,483 | | 12/1995 | Sun . | |
| 5,538,267 | | 7/1996 | Pasin et al. . | |
| 5,707,271 | * | 1/1998 | Kunz et al. | 446/128 X |

* cited by examiner

*Primary Examiner*—D. Neal Muir
(74) *Attorney, Agent, or Firm*—Roy A. Ekstrand

(57) ABSTRACT

A toy body formed to generally fanciful creature includes a tail portion and a head portion. A cockpit suitable for receiving and retaining a plush toy figure is positioned between the head and tail. A conventional sound circuit is supported within the interior of the head portion while a rotatable string reel is supported within the interior of the tail section. The reel supports a length of flexible string which includes an outer end secured to a toy life saver. A pocket within the body is provided for storing the toy life saver. The four supporting wheels of the push-pull toys body are supported upon respective axels in an offset or eccentric attachment. In addition, the front two wheel each include an offset cam and cam follower which cooperate and pivot an upwardly extending arm. The upwardly extending arm provides pivotal coupling to the forwardly extending arms and imparts pivotal motion thereto.

12 Claims, 2 Drawing Sheets

PUSH-PULL TOY HAVING PIVOTING ARMS

FIELD OF THE INVENTION

This invention relates generally to push-pull type toys and particularly to those which are enhanced with additional amusement features.

BACKGROUND OF THE INVENTION

Push-pull toys are extremely well known in the art and have been provided in a virtually endless of variety of types, sizes and configurations. The term push-pull refers generally to toys which are intended to be rolled along a floor surface by the child user who either pushes or pulls the toy upon the surface. Thus push-pull toys have been provided having rigid handles allowing a standing child to push or pull the toy figure upon a play surface. Alternatively, push-pull toys have been provided which utilize a flexible string secured to the toy and therefore intended to facilitate a pulling action. In such toys however, it has been found that children often enjoy kneeling down along side the toy and pushing it rather than using a pull string. As a result such toys have become collectively known as push-pull toys.

While a variety of such push-pull toys produced by practitioners in the toy art has been virtually endless, generally all include certain major toy components. A typical push-pull toy included a body or chassis for combination of both which provided the appearance and basic support of the push-pull toy. Various appearance themes are utilized in fabricating the body portion of the push-pull vehicle and such themes have included fanciful people and animals, monsters both realistic and fanciful, toy vehicle and cartoon-like appearances.

Many push-pull toys are in essence a small version of a wagon in that some sort of receptacle or cockpit is formed in the toy body for receiving and supporting one or more cooperating toy figures. In addition, a variety of accessory elements are often included in push-pull toys. Early on, mechanical sound producing apparatus were provided along with moving elements such as Ping-Pong balls or the like. With the advent of low cost small sized electronic sound circuits, many push-pull vehicles appeared utilizing such circuits to enhance amusement. In still others, articulated members or limbs are moved during the play pattern and in still others, visual features such as flashing lights and the like have been included.

Unfortunately, the high degree of amusement value and accessory inclusion in push-pull toys often results in overly complex and unreliable products. Complexity typically results in increasing cost and manufacture which in turn can price the product beyond the reasonable means of the intended consumer. As a result, practitioners in the toy art have found that they must balance the features included against the cost of providing such features in a push-pull toy. Of necessity of balancing results in a compromise of features to be included to attempt to maintain costs at a reasonable price.

For example U.S. Pat. No. 4,693,697 issued to Pagano sets forth a PUSH-PULL TOY having a body supporting a plurality of rolling wheels and an upper shell resembling a turtle. A head also reassembling a turtle extends from the body and is supported for movement. The shell body supports a closed cavity visible from the outside within which a plurality of light spherical objects such as Ping-Pong balls are captivated. One of the wheels is coupled to a reciprocating mechanism which moves the figures head and which periodically cocks and releases a spring loaded plunger to shoot the bottom most ball within the closed chamber against its upper transparent surface. A handle is provided for gripping by the child user to push or pull the toy.

U.S. Pat. No. 3,827,179 issued to Reiling Jr. sets forth a WHEELED TOY VEHICLE WITH CAM OPERATED OSULATING CHAIR AND STEERING WHEEL having a hull similar to a boat with a cabin supported on upper side thereof. A simulated steering wheel is rotatable supported above the cabin and is operatively coupled to drive mechanism responsive to the rotation of one of the wheels. As the toy is rolled across a play surface the wheels rotate and the mechanism operative on one wheel oscillates a chair supported on the cabin and rotates the simulated steering wheel.

U.S. Pat. No. Des. 360,237 issued to Chiu sets forth a SIMULATIVE TOY VEHICLE having a large figure generally representing a dinosaur or the like standing on its rear legs and feet. A cart is supported upon the dinosaur tail and includes rolling wheels on the underside thereof. An additional wheel is supported between the dinosaur figures legs allowing the vehicle to be rolled across a surface.

U.S. Pat. No. 3,782,751 issued to Williams sets forth OVAL SHAPED WHEELS having a wagon-like body supporting a plurality of rolling wheels formed in oval or elliptical shapes. The major and minor axes of the wheels are off set to provide a randomly oscillating character to the toy as it is rolled.

U.S. Pat. No. 4,568,307 issued to Gabler et al. sets forth a PUSH TOY VEHICLE WITH OPERABLE MOUTH having a chassis and body supported by a plurality of rolling wheels. The front portion of the body forms a fanciful lower jaw and lower teeth while the upper portion of the body supports a pivotal upper jaw and upper teeth. One of the rolling wheels is coupled to a drive mechanism which in turn is coupled to the pivotal jaw with the result that the mouth created by the upper and lowers jaws is periodically opened and closed as the toy vehicle is rolled across the play surface.

U.S. Pat. Nos. 4,772,242 issued to McKay et al entitled WHEELED TOY VEHICLE HAVING POUNDING FISTS and 4,573,944 issued to Crow et al. entitled BALL SWINGING TOY VEHICLE together with 5,334,078 issued to Hippely et al. entitled TOY VEHICLE HAVING ARTICULATED JAWS variously describe toy vehicle which employ a moveable articulated member or limb in a push toy environment. Still other U.S. Patents provide an interior compartment or cockpit of some type in a push toy environment. For example, U.S. Pat. No. 5,135,243 issued to Carpenter entitled CHILD'S CART and U.S. Pat. No. 5,474,483 issued to Sun and entitled WHEELED TOY CONTAINER WITH SURFACE TO ATTACH BLOCKS are exemplary of such push-pull toys having carrying capacity.

Many push-pull toys maintain their resemblance to the basic wagon and are intended to be operated in a similar manner. Examples of such wagons-like push-pull toys are found in U.S. Pat. 5,538,267 issued to Pasin et al. entitled CONVERTIBLE TOY WAGON HAVING ADDITIONAL STORAGE CAPASITY and U.S. Pat. No. 4,930,831 issued to Valiga et al. entitled SIDE EXTENTION FOR A TOY WAGON and U.S. Pat. No. 5,360,222 issued to Bro et al. entitled TOY WAGON.

While the foregoing described prior art devices have improved the art and in some instance enjoyed commercial success, there remains nonetheless a continuing need in the art for evermore amusing, interesting and cost effective push-pull toys.

SUMMARY OF THE INVENTION

Accordingly it is a object of the present invention to provide an improved push-pull toy. It is a more particular object of the present invention to provide an improved push-pull toy which amuses the user with a plurality of accessory figures while maintaining the manufacturing cost of the push-pull toy within a practical cost range.

In accordance with the present invention there is provided a push-pull toy comprising: a body defining an upwardly open cockpit; a toy figure receivable within the cockpit; a plurality of wheels rotatably secured to the body in an off-center attachment; at least one of the wheels having an offset cam rotatable therewith; at least one pivot arm pivotally supported by the body and including a cam follower receiving the offset cam, whereby rotation of the at least one wheel pivots the pivot arm; and an external arm secured to the at least one pivot arm so as to pivot vertically as the at least one pivot arm is pivoted by the cam, the wheels having their respective off-center character out of phase with each other causing the body to undulate in horizontal and vertical planes as the push-pull toy is rolled.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
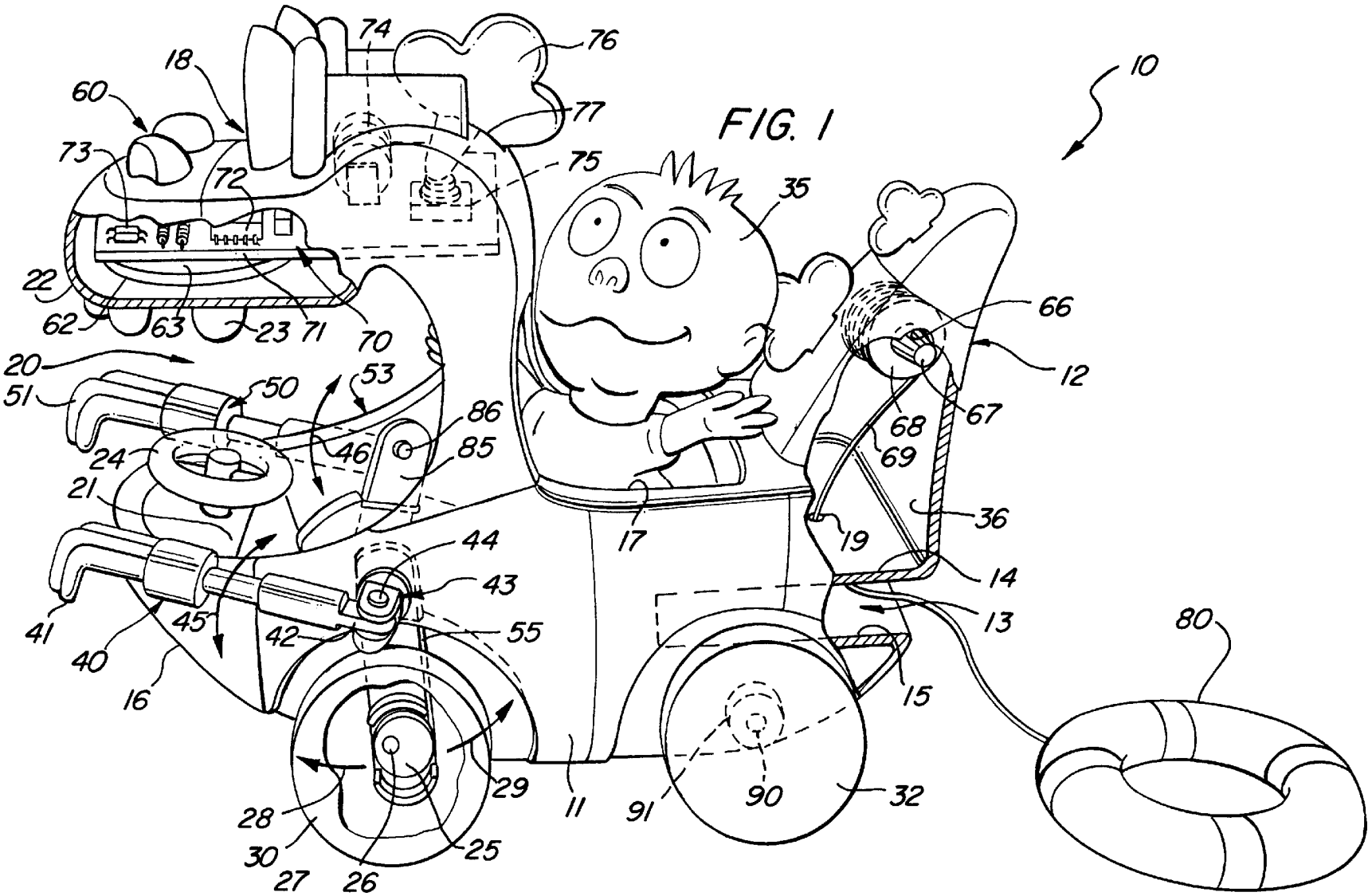
FIG. 1 sets forth a partially sectioned perspective view of a push-pull toy constructed in accordance with the present invention.

FIG. 1 sets forth a partially sectioned perspective view of a push-pull toy constructed in accordance with the present invention and generally referenced by numeral 10. Toy 10 includes a body 11 preferably of a molded plastic material or the like having a tail 12 extending upwardly at the rear portion of body 11 and a head 18 extending upwardly at the frontal portion of body 11. A lower front portion 16 cooperates with head 18 to form a mouth space 20 therebetween. In accordance with the present invention body 11 is rollingly supported by a plurality of off-center wheels 30 and 31 (wheel 31 seen in FIG. 2). A pair of rear wheels 32 and 33 (wheel 33 seen in FIG. 2) are also supported in a off-center or eccentric attachment to a common axel 90. In further accordance with the present invention an arm 55 extends downwardly on the interior of body 11 and supports an elongated cam follower 27 at the lower end thereof. A generally circular offset cam 25 is rotational supported upon body 11 by an axel 26. Axel 26 provides a fixed point of rotation about which cam 25 rotates together with wheel 30 in an eccentric rotation.

A identical structure is provided on the opposite side of body 11 for support of front wheel 31 (seen in FIG. 1). The structure of support for wheel 31 is set forth more clearly in FIG. 2 and described more extensively in combination therewith. However, suffice it to note here that arm 11 is pivotally secured to the interior surface of body 11 and defines a lower end having a cam follower and an offset cam which allows wheel 31 (seen in FIG. 2) to undergo an off-center or eccentric rotation in the same manner as wheel 30. In the preferred fabrication of the present invention wheels 30 and 31 are offset with respect to each other such that their emotions are correspondingly offset.

Push-pull toy 10 further includes a pair of arms 40 and 50 positioned on each side of body 11 next to lower jaw 21. Arms 40 and 50 define respective claw portions 41 and 51 at the frontal ends thereof. Arm 40 includes a flange 42 received within a coupler 43. Coupler 43 is secured to the upper end of arm 55 through an aperture (not shown) formed in the side of body 11. Of importance with respect of the present invention is the fixed coupling between coupler 43 and the upper end of arm 55. Flange 42 is pivotally secured within coupler 43 by a pin 44. As a result, arm 40 is pivotable about pin 44 toward or away from body 11 as desired. In addition, coupler 43 pivots in accordance with the pivotal movement of arm 55.

Cam follower 27 is formed at the lower end of arm 55 and receives cam 25 which in turn is supported by axel 26 such that rotation of cam 26 within cam follower 27 pivots arm 55 forwardly and rearwardly with respect to body 11 in the manner indicated by arrows 28 and 29. This pivotal movement communicates a corresponding pivotal movement to coupler 43 resulting in up-and-down pivotal movement of arm 40 in the manner indicated by arrows 45.

The rotation of cam 25 is provide as wheel 30 rotates. Thus wheel 30 is joined to and rotatable with cam 25 and shares it off-center point of attachment. As a result, an initial vertical offset character is applied to wheel 30 to produce a vertical lobbing between wheel 30 and body 11.

As described below in connection with FIG. 2 in greater detail a similar structure is formed upon arm 85 and thus rotation motion of front wheel 31 (seen in FIG. 2) pivots arm 85 in the same manner as described for arm 55 which in turn pivots arm 50 in the manner indicated by arrows 46. Coupler 53 identical to coupler 43 provides the same attachment which includes the ability to pivot arm 50 outwardly from body 11 or inwardly to be closer body 11.

Rear wheels 32 and 33 (wheel 33 seen in FIG. 2) are coupled to a common rear axel 90 in an eccentric or offset attachment. A hub 91 supporting wheel 32 is provided to rotationally support wheel 32 upon axel 90. As is better seen in FIG. 2 axel 90 extends through body 11 and provides a support for wheel 33 in the same manner as it supports wheel 32.

Body 11 further defines a rearwardly open pocket 13 formed of an upper cover 14 and a lower cover 15. A toy life saver 80 is receivable and storable within pocket 13. Tail 12 defines an interior 36 within which a reel 68 is rotatably supported by a pair of apertures formed in tail 12 such as aperture 66. A rotating knob 67 is secured to reel 68 and is used to wind a quantity of strings 69 upon reel 68. String 69 extends downwardly through aperture 19 formed in upper cover 14 and secures toy life preserver 80.

Cockpit 17 forms an upwardly open receiving area in which a toy FIG. 35 is placed to enhance the play pattern of push-pull toy 10. Toy FIG. 35 is preferably formed of a soft bodied or "plush" which is able to conform generally to cockpit 17 and thus able to sit reliably therein.

Head 18 defines an interior cavity 61 within which a conventional speaker or transducer 63 is supported. A speaker grill 62 is formed in upper jaw 22 underlying speaker 63 (grill 62 not shown). A sound circuit 70 includes a printed circuit board 71 supported within interior cavity 61 by conventional support means (not shown) within interior cavity 61. Sound circuit 70 is fabricated entirely in accordance with conventional fabrication techniques and thus includes an integrated sound circuit 72 having a plurality of additional components such as components 73 supported upon printed circuit board 71 which includes conventional conductive coupling pads therebetween (not shown). Printed circuit board 71 further supports a switch 75 and a plurality of batteries 74 each operatively coupled to the remainder of sound circuit 70 in accordance with conventional fabrication means.

As mentioned sound circuit 70 may be fabricated entirely in accordance with conventional fabrication techniques with the essential function of sound circuit 70 being the provision of appropriate signals for driving speaker 63 each time switch 75 is pressed. For example, a combination of a microprocessor, read only memory, speech synthesizer, and audio output amplifier suitable for the function of circuit 70 is formed as a single integrated circuit chip device manufactured by Texas Instruments Inc. under the device name TMS50C44. However, it will be understood by those skilled in the art that a variety of standard integrated circuit devices may be utilized for circuit 50.

Head 18 further defines an aperture 77 which receives a portion of a button 76. Button 76 extends through aperture 77 and rest upon switch 75. As a result, pressing button 76 inwardly actuates switch 75 which in turn caused sound circuit 70 to produce appropriate signals for driving speakers 63 and producing corresponding audible sound output. In the preferred fabrication of the present invention sound circuit 70 includes a plurality of digitally encoded sound such as words or phrases which is utilized by integrated circuit 72 to produce appropriate signals for speaker 63.

To complete the aesthetic of the head 18 a nose portion 60 supports aesthetic features while upper jaw 22 supports simulated teeth 23.

To further enhance the aesthetic appeal of toy 10 lower jaw 21 supports a simulated steering wheel 24.

Figure 2:
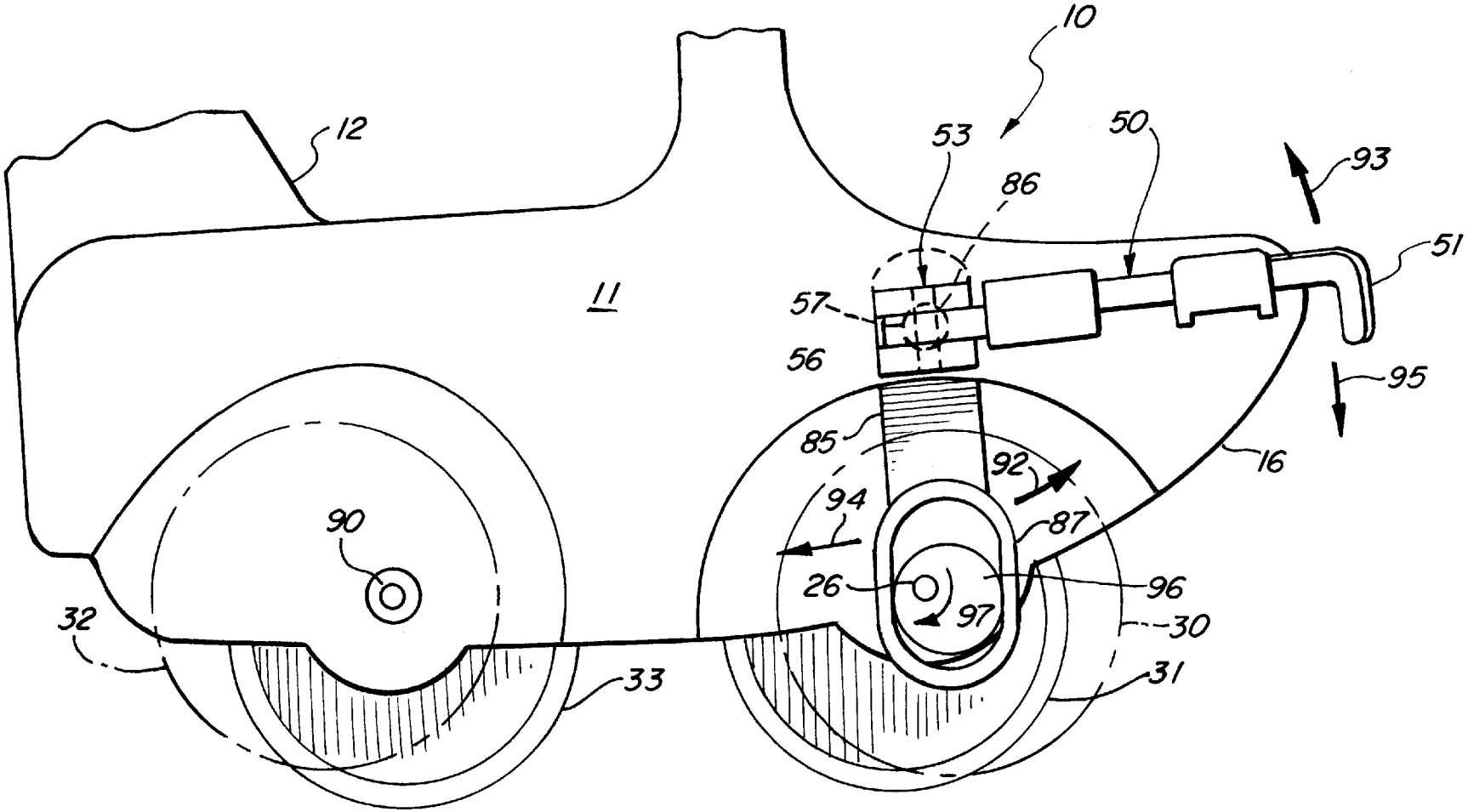
FIG. 2 sets forth a partial section side view of the present invention push-pull toy.

FIG. 2 sets forth a right side view of toy vehicle 10 having wheels 30 and 32 shown in dashed-line to facilitate illustration of the attachment mechanism for wheels 30 and 32. Thus body 11 includes an upwardly extending tail 12 and a frontal portion 16 as described above. Rear wheel 33 and front wheel 31 are shown rotatable and eccentrically supported on the far side of body 11 in the manner described above in FIG. 1. Wheel 32 (shown in dashed-line) is rotatably supported upon axel 90 in an eccentric or offset attachment it should be noted that the offset of wheel 32 is not aligned with wheel 33 producing an out of phase relationship for the undulations of wheels 32 and 33. Similarly, wheel 30 (shown in dashed-line) is rotatably supported by axel 26 in an eccentric or offset rotatable attachment. Cam 96 is correspondingly offset conforming generally to the offset of wheel 30. It will also be noted that wheels 30 and 31 are offset in an out of phase relationship similar to wheels 32 and 33 resulting in offset undulations of each wheel.

An elongated arm 85 includes a cam follower 87 at the lower end thereof which in encircles cam 96. Cam 96 is supported in an offset of eccentric relationship to an axel 26. Arm 85 extends upwardly to support a coupler 53 utilizing a pin 86. Pin 86 securely attaches the interior portion of coupler 53 to the upper end of arm 85 such that pivotal movement of arm 85 about pin 86 produces corresponding pivotal movement of coupler 53. v An arm 50 having a claw 51 includes a flange 56 received by coupler 53 in a pivotal attachment using pin 57.

In operation, as the user pulls or pushes toy 10 along a play surfaces wheels 30 through 33 are caused to rotate. Because of the offset rotatable support of each wheel the eccentric character thus produced in each wheel causes body 11 to undergo an erratic undulating motion as it moves across a play surface. In addition, the rotation of cam 96 within cam follower 87 as indicated for example by arrow 97 about axel 26 produces pivotal movement of arm 85 in the directions indicated by arrows 92 and 94. Because of the attachment of coupler 53 to the upper end of arm 85, a corresponding pivotal motion is imparted to arm 50. Thus forward pivotal movement of arm 85 in the direction indicated by arrow 92 produces corresponding upward motion of arm 50 in the direction indicated by arrow 93. Conversely, rearward motion of arm 85 in the direction indicated by arrow 94 lowers arm 50 in the direction indicated by arrow 95.

It will be recalled that an identical wheel structure for supporting wheel 30 and pivoting arm 40 is set forth above in FIG. 1. As a result moving push-pull toy 10 across a play surface induces the above described undulating travel while pivoting arms 40 and 50 (arm 40 seen in FIG. 1) up and down to provide an amusing and entertaining feature.

Toy life preserver 80 is normally stored within pocket 13 and is maintained therein by rotating knob 67 to wind a substantial amount of string 69 thereon. When desired however, the child user is able to remove toy life saver 80 from pocket 13 and draw string 69 outwardly unwinding wheel 68. Thereafter, string 69 may be again be wound upon reel 68 by rotating knob 67 and toy life saver 80 may again be stored in pocket 13.

What has been shown is a push-pull toy having a fanciful appearance which is supported by a plurality of wheels in eccentric attachment to provide an undulating or wobbly movement of the toy as it is rolled across a play surface. A pair of pivoting cam followers and cams are supported upon the body and driven by the front wheel of the toy vehicle to produce corresponding pivotal movement of a pair of forwardly extending arms. A sound circuit responds to movement of a control button to output predetermined audible sounds and speech for further entertainment. The toy includes a toy life saver coupled to a wind-up reel within the toy body by an elongated flexible string.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A push-pull toy comprising:

a body defining an upwardly open cockpit;

a toy figure receivable within said cockpit;

a plurality of wheels rotatably secured to said body in an off-center attachment;

at least one of said wheels having an offset cam rotatable therewith;

at least one pivot arm pivotally supported by said body and including a cam follower receiving said offset cam, whereby rotation of said at least one wheel pivots said pivot arm; and an external arm secured to said at least one pivot arm so as to pivot vertically as said at least one pivot arm is pivoted by said cam, said wheels having their respective off-center character out of phase with each other causing said body to undulate in horizontal and vertical planes as said push-pull toy is rolled.

2. The push-pull toy set forth in claim 1 further including a sound circuit and switch cooperating to provide audible sound when said switch is actuated.

3. The push-pull toy set forth in claim 2 wherein said plurality of wheels is comprised of four wheels arranged on said body as a pair of front wheels and a pair of rear wheels.

4. The push-pull toy set forth in claim 3 wherein said least one wheel is one of said pair of front wheels.

5. The push-pull toy set forth in claim 4 wherein said body includes a tail having an interior cavity therein and a rotatable string reel supported by said tail and wherein said push-pull toy includes a length of string secured to and wound upon said reel and having an outer end.

6. The push-pull toy set forth in claim 5 further including a toy article secured to said outer end.

7. The push-pull toy set forth in claim 6 wherein said toy article is a toroidal toy lifesaver.

8. A push-pull toy comprising:

a body defining an upwardly open cockpit;

a toy figure receivable within said cockpit;

a plurality of wheels including a pair of front wheels and a pair of rear wheels each rotatably secured to said body in an off-center attachment;

said pair of front wheels each having an offset cam rotatable therewith;

a pair of pivot arms pivotally supported by said body and including a pair of cam followers receiving said offset cams, whereby rotation of said pair of wheels pivots said pivot arms; and a pair of external arms secured to said pivot arms so as to pivot vertically as said pivot arms are pivoted by said cams, said wheels having their respective off-center character out of phase with each other causing said body to undulate in horizontal and vertical planes as said push-pull toy is rolled.

9. The push-pull toy set forth in claim 8 wherein said body includes a tail having an interior cavity therein and a rotatable string reel supported by said tail and wherein said push-pull toy includes a length of string secured to and wound upon said reel and having an outer end.

10. The push-pull toy set forth in claim 9 further including a toy article secured to said outer end.

11. The push-pull toy set forth in claim 10 wherein said toy article is a toroidal toy lifesaver.

12. The push-pull toy set forth in claim 8 further including a sound circuit and switch cooperating to provide audible sound when said switch is actuated.

* * * * *